US010219364B2

(12) United States Patent
Dickens

(10) Patent No.: US 10,219,364 B2
(45) Date of Patent: Feb. 26, 2019

(54) ELECTROSTATIC MICROTHRUSTER

(71) Applicant: NXP USA, Inc., Austin, TX (US)

(72) Inventor: Andrew Paul Dickens, Austin, TX (US)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 15/586,868

(22) Filed: May 4, 2017

(65) Prior Publication Data

US 2018/0324938 A1 Nov. 8, 2018

(51) Int. Cl.
*F03H 1/00* (2006.01)
*H05H 1/48* (2006.01)

(52) U.S. Cl.
CPC ..... *H05H 1/48* (2013.01); *F03H 1/0093* (2013.01)

(58) Field of Classification Search
CPC ... H05H 1/24; H05H 1/46; H05H 1/54; B64Q 1/22; B64Q 1/40; B64Q 1/405; F03H 1/00; F03H 1/006; F03H 1/0081; F03H 1/0087; F03H 1/0093
See application file for complete search history.

(56) References Cited

U.S. PATENT DOCUMENTS 4,789,801 A 12/1988 Lee
6,293,090 B1 * 9/2001 Olson ..... F03H 1/0081 313/231.31
6,295,804 B1 * 10/2001 Burton ..... F03H 1/00 60/202
6,334,302 B1 * 1/2002 Chang-Diaz ..... F03H 1/0093 60/203.1
6,492,784 B1 12/2002 Serrano
6,504,308 B1 1/2003 Krichtafovitch
7,395,656 B2 * 7/2008 Rooney ..... B64G 1/405 60/202
7,728,253 B2 6/2010 Hopwood
8,210,480 B2 * 7/2012 Moorer ..... B64G 1/1078 244/158.4
8,593,064 B2 * 11/2013 Chang Diaz ..... F03H 1/0093 315/111.61
8,613,188 B2 12/2013 Stein et al.
(Continued)

FOREIGN PATENT DOCUMENTS

CN 204380854 U 6/2015
EP 0903487 A2 3/1999
EP 1681465 B1 8/2012

OTHER PUBLICATIONS

Papadakis, A. P., et al: "Microplasmas: A Review", The Open Applied Physics Journal, 2011, 4, Open Access, pp. 45-63.
(Continued)

*Primary Examiner* — Jason Crawford

(57) ABSTRACT

Embodiments of the present invention provide for movement of a fluid around a small form-factor device, such as a semiconductor device die or package, through use of a microplasma. Embodiments provide for a microplasma generated in an ambient fluid with a lower power than predicted by a Paschen Curve for that fluid. The ionized molecules of the plasma can be manipulated by further generation of an electric field that can be used, for example, to move the ions in a desired direction. The movement of the ionized fluid generates a fluid flow of neighboring, non-ionized fluid molecules in the desired direction.

18 Claims, 4 Drawing Sheets

(56) References Cited

U.S. PATENT DOCUMENTS 9,060,412 B2 * 6/2015 Leiter ..... B64G 1/405
9,103,329 B2 * 8/2015 Corbett ..... F03H 1/0018
9,460,884 B2 10/2016 Hopwood et al.
2005/0051420 A1 3/2005 Botvinnik et al.
2006/0150611 A1 * 7/2006 Allen ..... F03H 1/0037 60/203.1
2007/0046219 A1 3/2007 Krichtafovitch et al.
2007/0089795 A1 * 4/2007 Jacob ..... B64C 23/005 137/827
2009/0229240 A1 * 9/2009 Goodfellow ..... B64G 1/401 60/202
2010/0127624 A1 * 5/2010 Roy ..... B64C 23/005 315/111.21
2011/0126929 A1 * 6/2011 Velasquez-Garcia ..... B01L 3/0268 137/561 R
2012/0304618 A1 * 12/2012 Roy ..... F03H 1/0037 60/203.1
2013/0038199 A1 * 2/2013 Roy ..... H05H 1/24 313/231.31
2013/0075382 A1 * 3/2013 Roy ..... G01M 9/04 219/201
2014/0159571 A1 * 6/2014 Hopwood ..... H05H 1/2406 315/39
2014/0202131 A1 * 7/2014 Boswell ..... H05H 1/46 60/202
2015/0115798 A1 * 4/2015 Szatkowski ..... H05H 1/46 315/111.21
2015/0123542 A1 * 5/2015 Sears ..... H01L 21/683 315/111.21
2015/0213991 A1 * 7/2015 Velasquez-Garcia ..... H01J 17/20 315/324
2016/0007436 A1 * 1/2016 Roy ..... B64C 23/005 315/111.41
2016/0068960 A1 * 3/2016 Jung ..... C23C 16/0245 427/2.25

OTHER PUBLICATIONS

Blajan, Marius, et al: "Emission Spectroscopy of Pulsed Powered Microplasma for Surface Treatment of PEN Film", Industry Applications Society Annual Meeting (IAS), Oct. 3-7, 2010, IEEE, pp. 1-8.

Liu, Peiyao, et al: "Diagnostics of Atmospheric Pressure Microwave Generated Micro-Plasma by Using Optical Emission Spectroscopy", Plasma Sciences (ICOPS) held with 2014 IEEE International Conference on High-Power Particle Beams (BEAMS), 2014 IEEE 41st International Conference, May 25-29, 2017, p. 1.

Krichtafovith, I.A., et al: "Electrostatic Fluid Accelerator and Air Purifier—The Second Wind", webpage: https://www.ee.washington.edu/research/seal/pubfiles/Krichtafovitch_ESA_June_05.pdf, pp. 1-13.

Arakoni, Ramesh A., et al: "Microdischarges for Use as Microthrusters: Modelling and Scaling", Journal of Physics D: Applied Physics, vol. 41, No. 10, Abstract.

Liu, P., et al: "Atmospheric Pressure Microwave-Powered Microplasma Source Based on Strip-Line Structure", Plasma Science (ICOPS), 2013 Abstracts IEEE International Conference, Jun. 16-21, 2013, p. 1.

Kothnur, P.S., et al: "Simulation of Direct-Current Microdischarges for Application in Electro-Thermal Class of Small Satellite Propulsion Devices", Contributions to Plasma Physics, vol. 47, Issue 1-2, Feb. 2007, Abstract.

Notice of Allowance dated Mar. 27, 2018 for U.S. Appl. No. 15/830,141, 14 pages.

Notice of Allowance dated Jul. 16, 2018 for U.S. Appl. No. 15830141, 13 pages.

* cited by examiner

ELECTROSTATIC MICROTHRUSTER

BACKGROUND

Field

This disclosure relates generally to semiconductor devices, and more specifically, to a mechanism for generating a microplasma and utilizing that microplasma to generate mechanical thrust or to move a fluid to a desirable location.

Related Art

Directing movement of a fluid across a surface or through an opening can be desirable for a variety of applications. For semiconductor devices, fluid motion (e.g., that of the ambient atmosphere surrounding the device) can be useful for cooling the device or directing movement of the fluid toward a sensor that is used to determine characteristics of the fluid. Typically, moving the fluid is performed by a fan, or another mechanical device, external to the device. But such external fluid movement devices are typically physically large and require significant power. This makes traditional devices inappropriate for applications that require low power and small form factors.

It is therefore desirable to have a mechanism for directing movement of a fluid over and around a semiconductor device that does so using low power and without a mechanical device.

BRIEF DESCRIPTION OF THE DRAWINGS

The present invention may be better understood, and its numerous objects, features, and advantages made apparent to those skilled in the art by referencing the accompanying drawings.

DETAILED DESCRIPTION

Embodiments of the present invention provide for movement of a fluid around a small form-factor device, such as a semiconductor device die or package, through the use of a microplasma. Embodiments provide for a microplasma generated in an ambient fluid with a low power. The ionized molecules of the plasma can be manipulated by further generation of an electric field that can be used, for example, to move the ions in a desired direction. The movement of the ionized portion of the fluid will generate a fluid flow of neighboring, non-ionized fluid molecules in the desired direction.

Plasmas can be used for a variety of applications, for example, materials processing, materials analysis, cleaning surfaces, propulsion, and on-chip cooling. For microchip-level applications, such as on-chip cooling or materials analysis, microplasma generation and manipulation can replace mechanical cooling systems. Microplasmas are plasmas that have a very small volume, typically on the order of microns. The geometry of the plasma can be altered through use of an electric field generated around the plasma. By moving the plasma, both the ionized molecules in the plasma and non-ionized molecules in the surrounding ambient gas can be moved in a desired direction. Such movement can be used to cool a surface of a semiconductor device, or could be used to direct the ambient gas molecules to a sensor that can detect characteristics of that ambient gas (e.g., composition, temperature, and the like).

A plasma can be generated by subjecting a gas to a strong electromagnetic field. This increases the number of electrons in the volume of gas, which thereby creates ionized particles, and may be accompanied by the dissociation of molecular bonds. The significant presence of charge carriers makes a plasma electrically conductive, so it responds strongly to electromagnetic fields. Unlike a non-ionized gas, under the presence of an electromagnetic field, a plasma can be manipulated to change shape or be moved in response to the electromagnetic field.

The breakdown voltage, $V_B$, is the voltage needed to start a plasma discharge between two electrodes in a gas. Electrons are provided to the gas from one of the electrodes (the cathode) and accelerated toward the other electrode (the anode). An electron provided by the cathode can collide with an electron of one of the gas molecules or atoms (e.g., colliding with an electron of a nitrogen molecule). If a gas molecule electron is dislodged due to the collision, the free electron will be accelerated toward the anode and may impact with an electron of another gas molecule. A series of collisions can lead to an avalanche breakdown resulting in an arc from the cathode to the anode and generation of a plasma.

Figure 1:
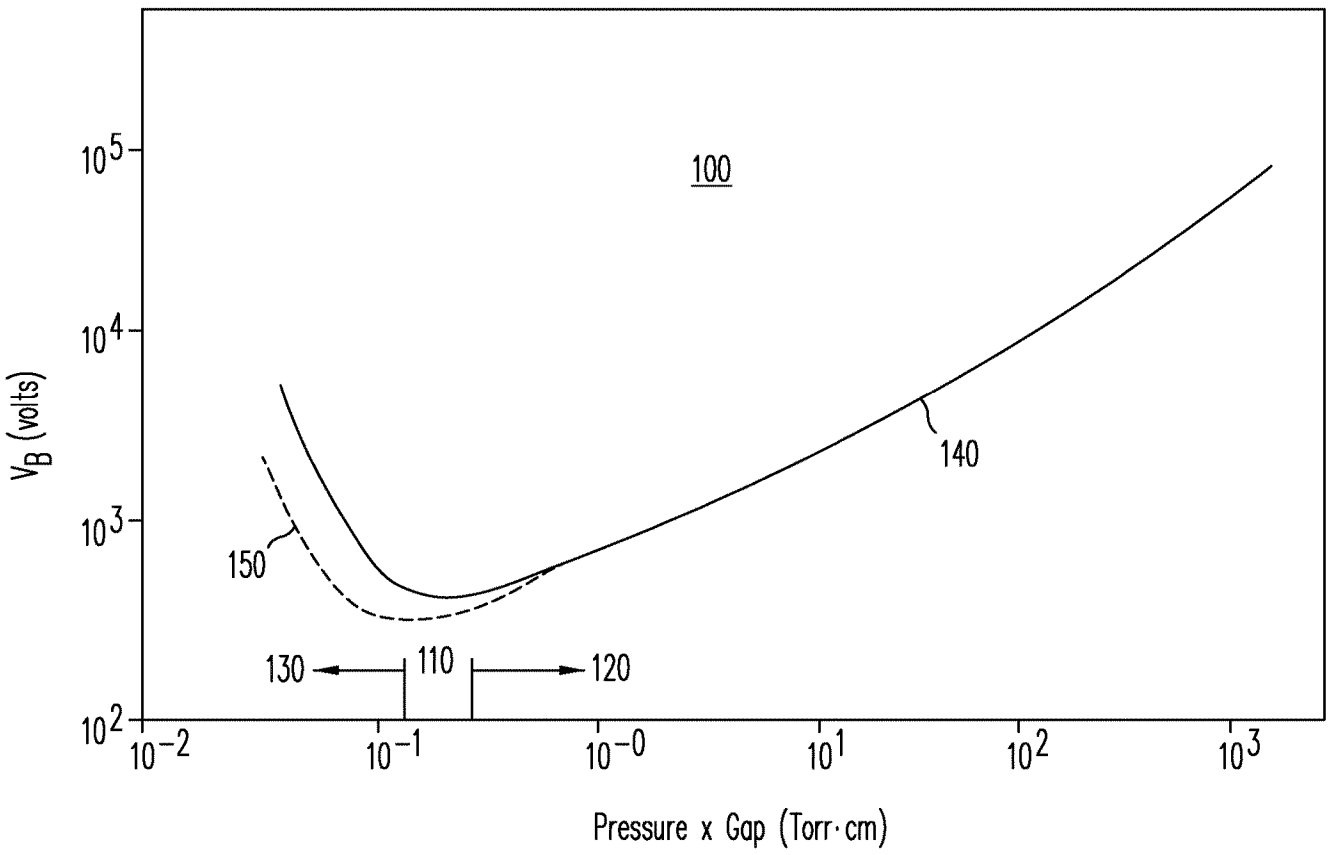
FIG. 1 illustrates an example of a Paschen's Law relationship between $V_B$ and the gas pressure (p) multiplied by the distance (d) between the two electrodes (e.g., Torr x cm).

Paschen's Law is an equation that empirically describes the relationship between a variety of physical parameters necessary to start and sustain a plasma. An example of the Paschen's Law relationship between $V_B$ and the gas pressure (p) multiplied by the distance (d) between the two electrodes (e.g., Torr x cm) is illustrated in FIG. 1. The solid line curve 140 in FIG. 1 illustrates the Paschen's Law curve for air. As can be seen, the breakdown voltage required to initiate a plasma has a minimum value in the (pd) range illustrated at 110. As (pd) increases from the values in 110 (i.e., in the range illustrated at 120), the breakdown voltage increases.

This is due to an increase in a number of gas molecules between the electrodes, from either an increased distance between the electrodes or a higher pressure providing an increased number of gas molecules. The increased number of molecules between the electrodes makes it more difficult to cause the avalanche breakdown that results in the plasma. Thus, the voltage needed to cause the plasma increases, as illustrated.

Further, as (pd) decreases below the values in 110 (i.e., in the range illustrated at 130), the breakdown voltage also increases. This is due to there being fewer gas molecules between the electrodes, either due to a decreased distance between the electrodes or due to a decrease in pressure of the gas. In this case, the availability of molecules to interact with the electrons emitted from the cathode is lower, leading to fewer ionizing collisions. Therefore, a greater voltage is needed to assure ionization of enough gas molecules to start an avalanche.

For semiconductor applications, in which operating at low power can be important, and in which distances are very small, mechanisms for generating a microplasma can fall near (pd) range 130 of FIG. 1. Thus, techniques for optimally generating such a microplasma and manipulating that microplasma to achieve a desired effect are desirable. Embodiments of the present invention provide a mechanism for generation and manipulation of such a microplasma.

Figure 2:
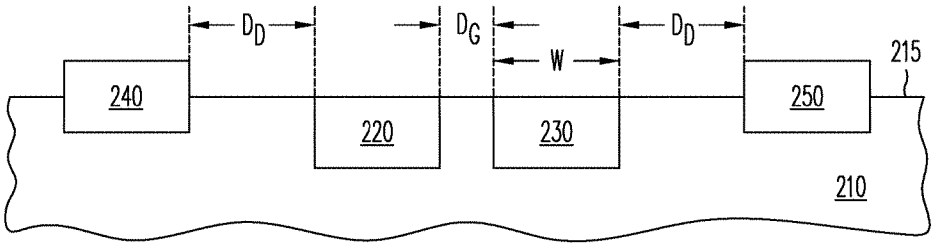
FIG. 2 is a simplified block diagram illustrating an electrode configuration on a semiconductor device package for generating and manipulating a microplasma, according to one embodiment of the present invention.

FIG. 2 is a simplified block diagram illustrating an electrode configuration on a semiconductor device package for generating and manipulating a microplasma, according to one embodiment of the present invention. Semiconductor device package 200 includes a dielectric substrate 210 that provides a major substrate surface 215. Generation electrodes 220 and 230 are formed to be inlaid within dielectric 210 each having an exposed top surface planar with major surface 215. By inlaying the generation electrodes in dielectric 210, field emission current in the gap between the electrodes is prevented. In order to prevent the field emission current in the gap, the dielectric material should have a high enough dielectric strength to resist the high electric field between the two electrodes (e.g., aluminum oxide and diamond, and the like).

Generation electrodes 220 and 230 are used to generate a microplasma in the fluid ambient to the generation electrodes and the substrate surface. It is desirable to have the gap distance (DG) between the generation electrodes at or below 0.25 microns. But this may result in falling within (pd) range 130 in FIG. 1, where the breakdown voltage begins to quickly rise. But the generation electrodes, especially the cathode, can be made in a geometry and material to encourage field emission of electrons (e.g., a sharp angle at the edge facing the other generation electrode), which will effectively shift the Paschen curve down, to allow for a lower breakdown voltage than expected for a gas at that pressure. This is illustrated by the dashed line curve 150 in FIG. 1. This is because the field emission electrons add to the number of electrons in the space between the electrodes, allowing for a greater number of collisions and a higher likelihood of ionization of gas molecules. A typical width (W) of the generation electrodes is in a range of 1-2 microns. During operation, generation electrodes 220 and 230 will form a high electric field region that will create an area of plasma generation.

Drive electrodes 240 and 250 are used to manipulate the plasma formed by the generation electrodes. The drive electrodes are formed to be partially inlaid in dielectric 210 with a portion of the electrode metal formed above major surface 215. In one embodiment, metal from drive electrodes 240 and 250 is about 1 micron above major surface 215. This height of the drive electrodes can be selected depending upon the application for manipulating the microplasma formed by generation electrodes 220 and 230. In the illustrated embodiment, a distance of drive electrode 250 from generation electrode 230 (DD) is about 2 microns. Similarly, the distance of drive electrode 240 from generation electrode 220 is about 2 microns. As with the height of the drive electrodes, distance DD can be selected depending upon the application.

The drive electrodes are used to manipulate the microplasma through the generation of an electrostatic force between the drive electrodes that interacts with the charged ions of the microplasma. The voltage for the drive electrodes will be selected in light of the application for manipulating the microplasma.

Figure 3:
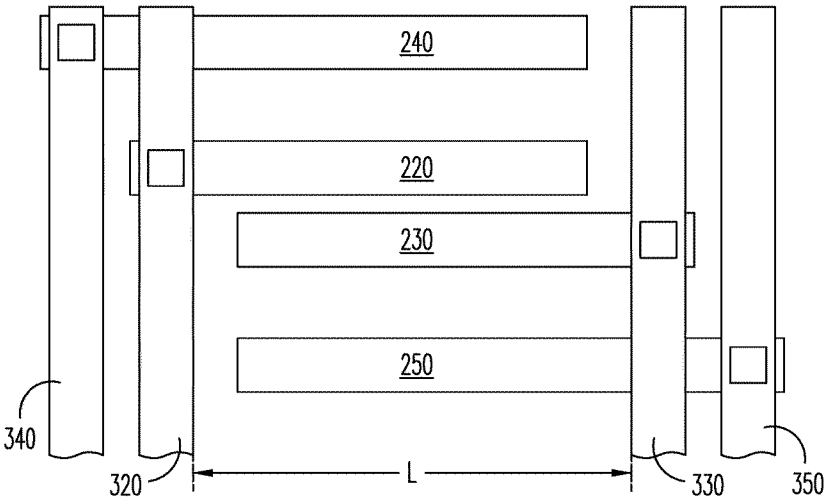
FIG. 3 is a simplified block diagram of a plan view illustrating an example of a bus configuration to supply power to the drive and generation electrodes of one embodiment of the present invention.

FIG. 3 is a simplified block diagram of a plan view illustrating an example of a bus configuration to supply power to the drive and generation electrodes, in accord with one embodiment of the present invention. In FIG. 3, each of the electrodes has a length L between buses 320 and 330. Length L is limited by the conductivity of the material used for the electrodes as well as the capacitance that may be generated between the closest electrodes (e.g., generation electrodes 220 and 230). As the capacitance builds, a response to voltage applied to the generation electrodes will be slower. A plasma can be generated between generation electrodes 220 and 230 along an exposed length of these electrodes. Similarly, the plasma can be manipulated by an electric field generated between drive electrodes 240 and 250, as discussed above.

Generation electrodes 220 and 230 can be supplied voltage via generation buses 320 and 330, respectively. Similarly, drive electrodes 240 and 250 can be supplied voltage via drive buses 340 and 350, respectively. This bus configuration can be used to drive multiple sets of generation electrodes and drive electrodes coupled along the length of the respective buses. In this manner, plasma ions can be generated and manipulated in stages to achieve an aggregate affect, as will be discussed in more detail below.

Figure 4:
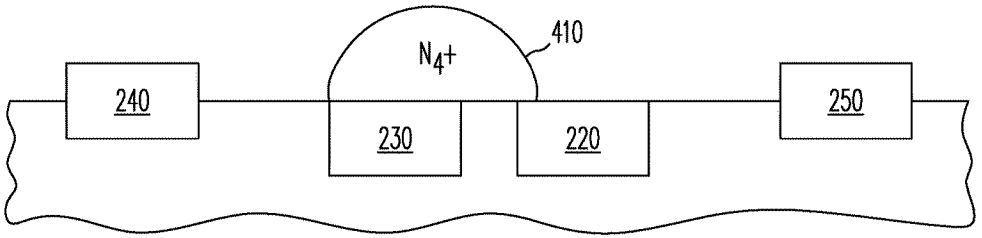
FIG. 4 is a simplified block diagram illustrating a cross-sectional example of formation of a plasma between the generation electrodes, in accord with one embodiment of the present invention.

FIG. 4 is a simplified block diagram illustrating a cross-sectional example of formation of a plasma between the generation electrodes with no generated field by the drive electrodes, in accord with one embodiment of the present invention. A plasma 410 is generated between generation electrodes 220 and 230, with generation electrode 220 being the cathode and generation electrode 230 being the anode. In this example, the ambient gas is air and the dominant ion in the plasma is nitrogen ($N_4$+).

Figure 5:
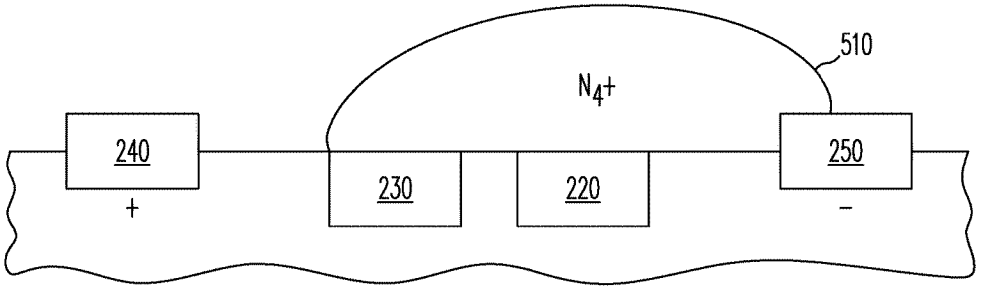
FIG. 5 is a simplified block diagram illustrating a cross-sectional example of a plasma generated between the generation electrodes under the influence of an electric field generated by the drive electrodes, in accord with one embodiment of the present invention.

FIG. 5 is a simplified block diagram illustrating a cross-sectional example of a plasma generated between the generation electrodes under the influence of an electric field generated by the drive electrodes, in accord with one embodiment of the present invention. Plasma 510 has a modified shape from that of FIG. 4 due to being attracted by the negative charge in drive electrode 250 and repelled by the positive charge in drive electrode 240. The nitrogen ions in the plasma then accumulate around drive electrode 250. The attraction of the nitrogen ions to drive electrode 250 can occur within 10 nanoseconds of applying the charge to the drive electrodes. This can result in a movement of not only the ionized gas molecules but also the neutral gas molecules in contact with the plasma.

Figure 6:
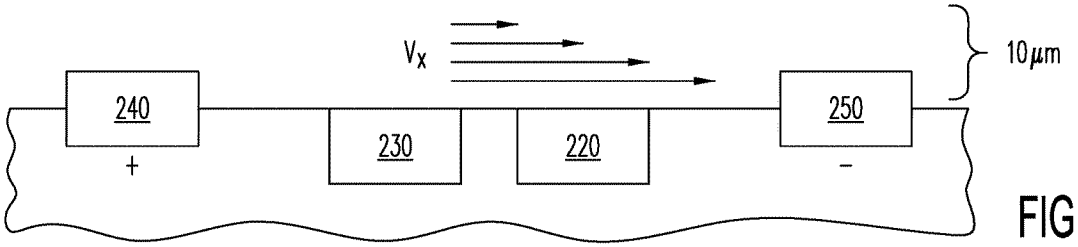
FIG. 6 is a simplified cross-sectional block diagram illustrating fluid velocity of ambient gas, including non-ionized molecules, due to the influence of the electric field generated by the drive electrodes, in accord with one embodiment of the present invention.

FIG. 6 is a simplified cross-sectional block diagram illustrating fluid velocity due to the influence of the electric field generated by the drive electrodes, in accord with one embodiment of the present invention. Molecules of the ambient gas, both ionized and non-ionized, are moved in the direction of the plasma distortion from the drive electrodes (here toward drive electrode 250). This effect occurs within a boundary layer above the surface approximately 10 microns for the microplasmas generated by embodiments of the present invention. Molecules closer to the surface move faster than those further away from the surface. This is due to those closer to the surface being ionized molecules moving due to the drive electrode field while those further away from the surface may contain a significant percentage of non-ionized molecules moving due to impact of the ionized molecules. Average air speed caused by one example of use of the present invention is about 1.2 m/s.

Figure 7:
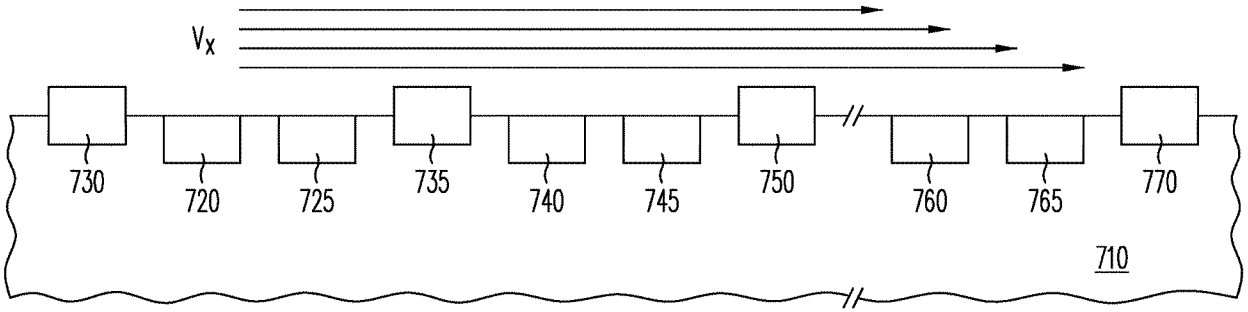
FIG. 7 is a simplified cross-sectional block diagram illustrating fluid velocity due to the influence of the electric field generated by a series of stages of generation electrodes and drive electrodes, in accord with one embodiment of the present invention.

FIG. 7 is a simplified cross-sectional block diagram illustrating fluid velocity due to the influence of the electric field generated by a series of stages of generation electrodes and drive electrodes, in accord with one embodiment of the present invention. In this example, generation electrodes 720, 725, 740, 745, 760, and 765 are linearly configured on along a major surface of substrate 710. Between anode/cathode pairs of the generation electrodes (e.g., 720 and 725, 740 and 745, 760 and 765, respectively) are drive electrodes 730, 735, 750, and 770. Charge on the drive electrodes can be periodically changed to attract a plasma from the stage to the left (in a left to right flow) and then repel that plasma to the next drive electrode to the right. This provides for an increasing flow velocity along the major surface of substrate 710.

In light of the dimensions of the microplasma generator discussed with respect to FIG. 2, above, there can be approximately 80-100 stages per millimeter in length along substrate 710. Using 64 nW of power, the ambient air in the affected region (within 10 nm of the major surface of the substrate) can be accelerated approximately 1.2 m/s per stage with approximately 16 nN of force per stage per 1 mm depth. In another embodiment of the present invention, a 1 $mm^2$ device can generate a force of 1.6 μN at 6.4 μW or a 1 $cm^2$ device can generate a force of 160 μN at 640 μW. Such a force from a 1 $cm^2$ device could, for example, accelerate a 38 gram mass that includes the microplasma generator at a rate of 0.4 $mm/s^2$, or alternatively accelerate the boundary layer fluid across the surface of an affixed device.

Figure 8:
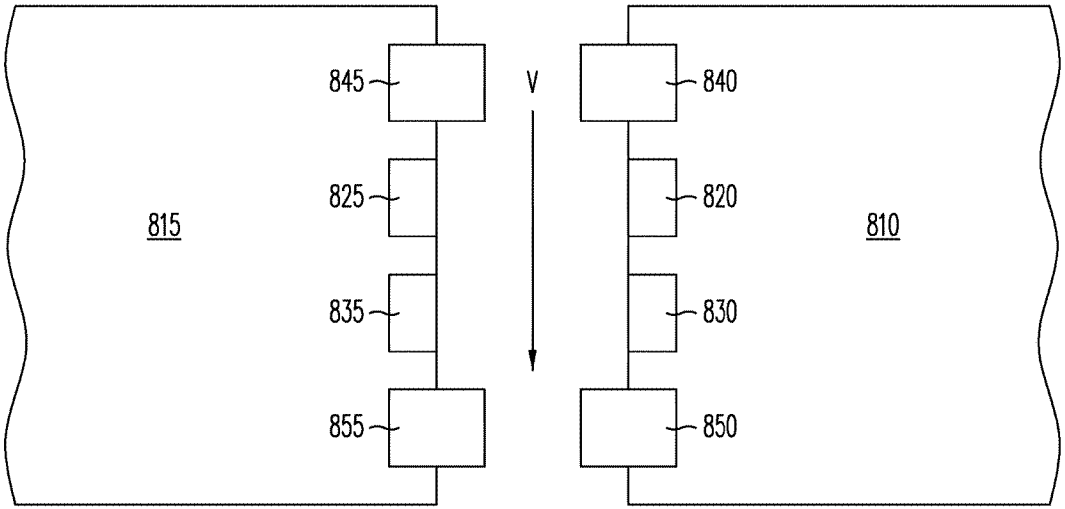
FIG. 8 is a simplified cross-sectional block diagram illustrating an alternative embodiment of the present invention.

FIG. 8 is a simplified cross-sectional block diagram illustrating another configuration of an embodiment of the present invention. In this embodiment, substrate portions 810 and 815 each have opposing substrate surfaces on which microplasma generation and drive electrodes are located (e.g., in a surface trench or a through via). Generation electrodes 820 and 830 are located on the major surface of substrate portion 810, while generation electrodes 825 and 835 are located on the major surface of substrate portion 815. In the illustrated embodiment, the generation electrodes are located substantially opposite one another on the major surfaces of the substrate portions. In this manner, microplasmas generated by each set of generation electrodes will be in close proximity to one another. If the spacing of the gap between the major surfaces is sufficiently small, the microplasmas generated by each set of generation electrodes can merge.

In addition, FIG. 8 provides a set of drive electrodes 840 and 850 located on the major surface of substrate portion 810, and a set of drive electrodes 845 and 855 located on the major surface of substrate portion 815. These drive electrodes can be operated in concert to affect the position of the ionized particles in the microplasmas generated by the generation electrodes. In addition, the non-ionized portion of the ambient gases in the region between the major surfaces of the substrate portions will move due to the impact of ionized molecules with non-ionized molecules. As with the examples discussed above, this will cause the fluid between the major surfaces to move with a velocity V.

It should be understood that the substrate portions 810 and 815 can be separate substrates positioned in proximity to one another, or a trench formed in a single substrate, or a via formed in a substrate having the described electrodes formed within it, depending upon the nature of the application. Fluid molecules, both ionized and non-ionized, can be moved through the region between the substrate portions to provide either a jet to be used for a variety of purposes such as cooling or directing the fluid to a desired sensor.

The substrates described herein can be any semiconductor material or combinations of materials, such as gallium arsenide, silicon germanium, silicon-on-insulator (SOI), silicon, monocrystalline silicon, the like, and combinations of the above. In addition, the substrate can be a PCB or any other type of substrate capable of supporting the conductors and conductive materials described.

The conductors described herein can include a material such as amorphous silicon, polysilicon, a nitride, a metal-containing material, another suitable material, and the like, or any combination thereof. In one embodiment, the material can include platinum, palladium, iridium, osmium, ruthenium, rhenium, indium-tin, indium-zinc, aluminum-tin, or any combination thereof. The generation electrodes should be made of a durable conductive material to resist plasma effects (e.g., sputtering). Examples of such materials include titanium, tungsten, an alloy including these materials, or a material clad with these materials. In addition, the field effect properties of the cathode would be enhanced by using a lower work function material. Conductive layers can be grown or deposited using a conventional or proprietary technique, such as a CVD technique, PVD technique, the like, or any combination thereof.

The conductors as discussed herein may be illustrated or described in reference to being a single conductor, a plurality of conductors, unidirectional conductors, or bidirectional conductors. However, different embodiments may vary the implementation of the conductors.

By now it should be appreciated that there has been provided a microplasma generator that includes a substrate with a major surface, a first generation electrode formed on the major surface, and a second generation electrode formed on the major surface. One of the first and second generation electrodes is configured to be a field emitting electrode when voltage is applied. A distance between edges of the first generation electrode and the second generation electrode is such that a plasma can be formed in an ambient gas at a predetermined voltage difference between the first generation electrode and the second generation electrode, wherein the ambient gas is in contact with the major surface at a first pressure.

In one aspect of the above embodiment, the distance between the edges of the first and second generation electrodes is such that the distance multiplied by the first pressure is at or below a minimum of a Paschen curve for the ambient gas at the first pressure for the predetermined voltage. In another aspect of the above embodiment, the distance between the edge of the first generation electrode to the edge of the second generation electrode is at or about 0.25 microns. In a further aspect, the ambient gas comprises air at one atmosphere pressure.

In another aspect of the above embodiment, the microplasma generator further comprises a first drive electrode formed on the major surface and a second drive electrode formed on the major surface. The first drive electrode is formed closer to the first generation electrode and formed external to the region between the first and second generation electrodes. The second drive electrode is formed closer to the second generation electrode and formed external to the region between the first and second generation electrodes. The first and second drive electrodes are formed such that an electric field formed between the first and second drive electrodes can attract the plasma to one of the first and second drive electrodes. In a further aspect, a distance between the first drive electrode and the first generation electrode is at or about two microns and a distance between the second drive electrode and the second generation electrode is at or about 2 microns. In another further aspect, the first drive electrode is formed such that an exposed surface of the first drive electrode is formed at or about 1 micron above the major surface of the substrate and the second drive electrode is formed such that an exposed surface of the second drive electrode is formed at or about 1 micron above the major surface of the substrate.

In yet another further aspect of the above aspect, the microplasma generator includes third and a fourth generation electrodes formed on the major surface. The third generation electrode is formed closer to the second drive electrode than the first drive electrode, and formed external to the region between the first and second drive electrodes. The fourth generation electrode is formed such that a distance between edges of the third generation electrode and the fourth generation electrode is such that a plasma can be formed in the ambient gas at a predetermined voltage difference between the third generation electrode and the fourth generation electrode. In a further aspect, the microplasma generator includes a third drive electrode formed on the major surface. The third drive electrode is formed closer to the fourth generation electrode than the third generation electrode and formed external to the region between the third and fourth generation electrodes. The second and third drive electrodes are formed such that an electric field formed between the second and third drive electrodes can attract the plasma to one of the second and third drive electrodes. In a yet further aspect, the first, second, and third drive electrodes are configured to provide a first charge configuration that attracts the plasma to the second drive electrode during a first time period, and a second charge configuration that attracts the plasma to the third drive electrode from the second drive electrode during a second time period.

In another aspect of the above embodiment, the microplasma generator further includes a second substrate having a second major surface, where the second major surface is substantially parallel to the major surface of the substrate. Third and fourth generation electrodes are formed on the second major surface. The third generation electrode is located opposite the first generation electrode across the space between the major surface and the second major surface. The fourth generation electrode is located opposite the second generation electrode across the space between the major surface and the second major surface. A distance between edges of the third generation electrode and the fourth generation electrode is such that a second plasma can be formed in the ambient gas at a predetermined voltage difference between the third generation electrode and the fourth generation electrode, where the ambient gas is in contact with the second major surface.

In a further aspect, the microplasma generator includes a third drive electrode and a fourth drive electrode formed on the second major surface. The third drive electrode is formed closer to the third generation electrode and formed external to the region between the third and fourth generation electrodes. The fourth drive electrode is formed closer to the fourth generation electrode formed external to the region between the third and fourth generation electrodes. The third and fourth drive electrodes are formed such that an electric field formed between the third and fourth drive electrodes can attract the second plasma to one of the third and fourth drive electrodes. A distance between the major surface and the second major surface is such that movement of the second plasma can affect movement of non-ionized molecules of the ambient gas near the plasma and movement of the plasma can affect movement of non-ionized molecules of the ambient gas near the second plasma.

Another embodiment of the present invention is a method for providing a microplasma generator. The method includes providing a first generation electrode on a major surface of a substrate, providing a second generation electrode on the major surface of the substrate, providing an ambient gas at a first pressure in contact with the major surface and the first and second generation electrodes, applying a predetermined voltage difference between the first generation electrode and the second generation electrode where one of the first and second generation electrode is configured to be a field emitting electrode when a voltage is applied, and forming a plasma in the ambient gas between the first generation electrode and the second generation electrode. The distance between edges of the first and second generation electrodes is such that the distance multiplied by the first pressure is at or below a minimum of a Paschen curve for the ambient gas at the first pressure for the predetermined voltage. In one aspect of the above embodiment, the distance between the edge of the first generation electrode to the edge of the second generation electrode is at or about 0.25 microns and the ambient gas comprises air at one atmosphere pressure.

In another aspect of the above embodiment, the method further includes providing a first drive electrode formed on the major surface, providing a second drive electrode on the major surface, and applying a voltage difference to the first and second drive electrodes to attract the plasma to one of the first and second drive electrodes. The first drive electrode is closer to the first generation electrode and external to the region between the first and second generation electrodes. The second drive electrode is closer to the second generation electrode and external to the region between the first and second generation electrodes. In a further aspect, the distance between the first drive electrode and the first generation electrode is at or about 2 microns and a distance between the second drive electrode and the second generation electrode is at or about 2 microns.

Another embodiment of the present invention provides a microplasma generator that includes a substrate having a major surface, a first generation electrode formed on the major surface, a second generation electrode formed on the major surface, a first generation bus formed in the substrate and coupled to the first generation electrode, and a second generation us formed in the substrate and coupled to the second generation electrode. One of the first and second generation electrode is configured to be a field emitting electrode when a voltage is applied. A distance between edges of the first generation electrode and the second generation electrode is such that a plasma can be formed in an ambient gas at a predetermined voltage difference between the first generation electrode and the second generation electrode, where the ambient gas is in contact with the major surface and at a first pressure. The first and second generation busses are configured to provide the predetermined voltage difference to the first and second generation electrodes.

In one aspect of the above embodiment, the distance between the edges of the first and second generation electrodes is such that the distance multiplied but the first pressure is at or below a minimum of a Paschen curve for the ambient gas at the first pressure for the predetermined voltage. In a further aspect, the microplasma generator further includes: a first drive electrode formed on the major surface, a second drive electrode formed on the major surface, a first drive bus formed in the substrate and coupled to the first drive electrode, and a second drive bus formed in the substrate and coupled to the second drive electrode. The first drive electrode is formed closer to the first generation electrode and formed external to the region between the first and second generation electrodes. The second drive electrode is formed closer to the second generation electrode and formed external to the region between the first and second generation electrodes. The first and second drive electrodes are formed such that an electric field formed between the first and second drive electrodes can attract the plasma to one of the first and second drive electrodes. The first and second drive busses are configured to provide a voltage differential to the first and second drive electrodes sufficient to form the electric field. In a still further aspect, the microplasma generator includes a third generation electrode formed on the major surface, a fourth generation electrode formed on the major surface, and a third drive electrode formed on the major surface. The third generation electrode is formed closer to the second drive electrode than the first drive electrode, and formed external to the region between the first and second drive electrodes, and the third generation electrode is coupled to the first generation bus. A distance between edges of the third generation electrode and the fourth generation electrode is such that a plasma can be formed in the ambient gas at a predetermined voltage difference between the third generation electrode and the fourth generation electrode, and the fourth generation electrode is coupled to the second generation bus. The third drive electrode is formed closer to the fourth generation electrode than the third generation electrode and formed external to the region between the third and fourth generation electrodes. The second and third drive electrodes are formed such that an electric field formed between the second and third drive electrodes can attract the plasma to one of the second and third drive electrodes. The third drive electrode is coupled to the first drive bus.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A microplasma generator comprising:

a substrate comprising a substrate surface;

a first generation electrode located on the substrate surface; and a second generation electrode located on the substrate surface, wherein one of the first and second generation electrode is configured to be a field emitting electrode when a voltage is applied, and a distance between edges of the first generation electrode and the second generation electrode is such that a plasma can be formed in an ambient gas at a predetermined voltage difference between the first generation electrode and the second generation electrode, wherein the ambient gas is in contact with the substrate surface and at a first pressure;

a first drive electrode located on the substrate surface, wherein the first drive electrode is located closer to the first generation electrode and located external to the region between the first and second generation electrode; and a second drive electrode located on the substrate surface, wherein the second drive electrode is located closer to the second generation electrode and located external to the region between the first and second generation electrodes, and the first and second drive electrodes are located such that an electric field formed between the first and second drive electrodes can attract the plasma to one of the first and second drive electrodes.

2. The microplasma generator of claim 1 wherein the distance between the edges of the first and second generation electrodes is such that the distance multiplied by the first pressure is at or below a minimum of a Paschen curve for the ambient gas at the first pressure for the predetermined voltage.

3. The microplasma generator of claim 1 wherein the distance between the edge of the first generation electrode to a nearest edge of the second generation electrode is at or about 0.25 microns.

4. The microplasma generator of claim 3 wherein the ambient gas comprises air at one atmosphere pressure.

5. The microplasma generator of claim 1 wherein a distance between nearest edges of the first drive electrode and the first generation electrode is at or about 2 microns and a distance between nearest edges of the second drive electrode and the second generation electrode is at or about 2 microns.

6. The microplasma generator of claim 1 wherein the first drive electrode is formed such that an exposed surface of the first drive electrode is formed at or about 1 micron above the substrate surface, and the second drive electrode is formed such that an exposed surface of the second drive electrode is formed at or about 1 micron above the substrate surface.

7. The microplasma generator of claim 1 further comprising:

a third generation electrode located on the substrate surface, wherein the third generation electrode is located closer to the second drive electrode than the first drive electrode, and located external to the region between the first and second drive electrodes; and a fourth generation electrode located on the substrate surface, wherein a distance between edges of the third generation electrode and the fourth generation electrode is such that a plasma can be formed in the ambient gas at a predetermined voltage difference between the third generation electrode and the fourth generation electrode.

8. The microplasma generator of claim 7 further comprising:

a third drive electrode located on the substrate surface, wherein the third drive electrode is located closer to the fourth generation electrode than the third generation electrode and located external to the region between the third and fourth generation electrodes, and the second and third drive electrodes are located such that an electric field formed between the second and third drive electrodes can attract the plasma to one of the second and third drive electrodes.

9. The microplasma generator of claim 8, wherein the first, second, and third drive electrodes are configured to provide a first charge configuration that attracts the plasma to the second drive electrode during a first time period and a second charge configuration that attracts the plasma to the third drive electrode from the second drive electrode during a second time period.

10. The microplasma generator of claim 1 further comprising:

a second substrate comprising a second substrate surface, wherein the second substrate surface is substantially parallel to the substrate surface;

a third generation electrode formed on the second substrate surface, wherein the third generation electrode is located opposite the first generation electrode across the space between the substrate surface and the second substrate surface;

a fourth generation electrode formed on the second substrate surface, wherein the fourth generation electrode is located opposite the second generation electrode across the space between the substrate surface and the second substrate surface, a distance between edges of the third generation electrode and the fourth generation electrode is such that a second plasma can be formed in the ambient gas at a predetermined voltage difference between the third generation electrode and the fourth generation electrode, wherein the ambient gas is in contact with the second substrate surface.

11. The microplasma generator of claim 10 further comprising:

a third drive electrode formed on the second substrate surface, wherein the third drive electrode is formed closer to the third generation electrode and formed external to the region between the third and fourth generation electrodes; and a fourth drive electrode formed on the second substrate surface, wherein the fourth drive electrode is formed closer to the fourth generation electrode and formed external to the region between the third and fourth generation electrodes, and the third and fourth drive electrodes are formed such that an electric field formed between the third and fourth drive electrodes can attract the second plasma to one of the third and fourth drive electrodes, and a distance between the substrate surface and the second substrate surface is such that movement of the second plasma can affect movement of non-ionized molecules of the ambient gas near the plasma and movement of the plasma can affect movement of non-ionized molecules of the ambient gas near the second plasma.

12. A method for providing a microplasma generator, the method comprising:

providing a first generation electrode on a substrate surface;

providing a second generation electrode on the substrate surface;

providing an ambient gas at a first pressure in contact with the substrate surface and the first and second generation electrodes;

applying a predetermined voltage difference between the first generation electrode and the second generation electrode, wherein one of the first and second generation electrode is configured to be a field emitting electrode when a voltage is applied;

forming a plasma in the ambient gas between the first generation electrode and the second generation electrode, wherein the distance between edges of the first and second generation electrodes is such that the distance multiplied by the first pressure is at or below a minimum of a Paschen curve for the ambient gas at the first pressure for the predetermined voltage;

providing a first drive electrode formed on the substrate surface, wherein the first drive electrode is closer to the first generation electrode and external to the region between the first and second generation electrodes;

providing a second drive electrode formed on the substrate surface, wherein the second drive electrode is closer to the second generation electrode and external to the region between the first and second generation electrodes; and applying a voltage difference to the first and second drive electrodes to attract the plasma to one of the first and second drive electrodes.

13. The method of claim 12 wherein the distance between the edge of the first generation electrode to the nearest edge of the second generation electrode is about 0.25 microns and the ambient gas comprises air at one atmosphere pressure.

14. The method of claim 12 wherein a distance between nearest edges of the first drive electrode and the first generation electrode is at or about 2 microns and a distance between the second drive electrode and the second generation electrode is at or about 2 microns.

15. A microplasma generator comprising:

a substrate comprising a substrate surface;

a first generation electrode located on the substrate surface;

a second generation electrode located on the substrate surface, wherein one of the first and second generation electrode is configured to be a field emitting electrode when a voltage is applied, and a distance between edges of the first generation electrode and the second generation electrode is such that a plasma can be formed in an ambient gas at a predetermined voltage difference between the first generation electrode and the second generation electrode, wherein the ambient gas is in contact with the substrate surface and at a first pressure;

a first generation bus located in the substrate and coupled to the first generation electrode; and a second generation bus located in the substrate and coupled to the second generation electrode, wherein the first and second generation busses are configured to provide the predetermined voltage difference to the first and second generation electrodes.

16. The microplasma generator of claim 15 wherein the distance between the edges of the first and second generation electrodes is such that the distance multiplied by the first pressure is at or below a minimum of a Paschen curve for the ambient gas at the first pressure for the predetermined voltage.

17. The microplasma generator of claim 16 further comprising:

a first drive electrode located on the substrate surface, wherein the first drive electrode is located closer to the first generation electrode and formed external to the region between the first and second generation electrode;

a second drive electrode located on the substrate surface, wherein the second drive electrode is located closer to the second generation electrode and formed external to the region between the first and second generation electrodes, and the first and second drive electrodes are located such that an electric field formed between the first and second drive electrodes can attract the plasma to one of the first and second drive electrodes;

a first drive bus located in the substrate and coupled to the first drive electrode; and a second drive bus located in the substrate and coupled to the second drive electrode, wherein the first and second drive busses are configured to provide a voltage differential to the first and second drive electrodes sufficient to form the electric field.

18. The microplasma generator of claim 17 further comprising:

a third generation electrode located on the substrate surface, wherein the third generation electrode is located closer to the second drive electrode than the first drive electrode, and located external to the region between the first and second drive electrodes, and the third generation electrode is coupled to the first generation bus;

a fourth generation electrode located on the substrate surface, wherein a distance between edges of the third generation electrode and the fourth generation electrode is such that a plasma can be formed in the ambient gas at a predetermined voltage difference between the third generation electrode and the fourth generation electrode, and the fourth generation electrode is coupled to the second generation bus; and a third drive electrode located on the substrate surface, wherein the third drive electrode is located closer to the fourth generation electrode than the third generation electrode and located external to the region between the third and fourth generation electrodes, and the second and third drive electrodes are located such that an electric field formed between the second and third drive electrodes can attract the plasma to one of the second and third drive electrodes, and the third drive electrode is coupled to the first drive bus.

* * * * *